US007048208B1

(12) United States Patent
Pruitt et al.

(10) Patent No.: US 7,048,208 B1
(45) Date of Patent: May 23, 2006

(54) POP-UP SPRINKLER INCLUDING WATER SPRAY DIVERTER

(76) Inventors: Cherie Y. Pruitt, 1738 Mary Augusta St., Manteca, CA (US) 95377; Pieter Boutmy, P.O. Box 13365, So. Lake Tahoe, CA (US) 96151

( * ) Notice: Subject to any disclaimer, the term of this patent is extended or adjusted under 35 U.S.C. 154(b) by 16 days.

(21) Appl. No.: 10/856,199

(22) Filed: Jun. 1, 2004

(51) Int. Cl.
*B05B 1/26* (2006.01)
*B05B 1/14* (2006.01)

(52) U.S. Cl. ..... 239/461; 239/200; 239/201; 239/204

(58) Field of Classification Search ..... 239/104, 239/200, 201, 204, 461, 503, 504, 505, 507, 239/509, 510, 511, 513, 514, 518, 521, 523, 239/524, DIG. 1
See application file for complete search history.

(56) References Cited

U.S. PATENT DOCUMENTS 3,106,347 A * 10/1963 Hayes ..... 239/505
3,830,434 A 8/1974 Green et al.
4,376,513 A * 3/1983 Hagar ..... 239/231
4,781,327 A 11/1988 Lawson et al.
D303,138 S 8/1989 Smith
5,137,307 A 8/1992 Kinsey
5,803,365 A * 9/1998 Ruttenberg ..... 239/204
5,931,385 A 8/1999 Miller
6,134,789 A 10/2000 Strickland
6,439,476 B1 8/2002 Boggs

* cited by examiner

*Primary Examiner*—David A. Scherbel
*Assistant Examiner*—Jason Boeckmann

(57) ABSTRACT

A pop-up sprinkler includes a base member positionable above a ground surface and a sprinkler head having a substantially cylindrical conduit provided with a proximal end portion in fluid communication with a water supply source. The sprinkler head further has a distal end portion having a plurality of tapered apertures randomly spaced thereabout for receiving a first array of water. The distal end portion further has a slot formed therein for defining a ledge along a select portion of the conduit. The sprinkler further includes a plurality of diverters slidably positionable within the slot. The plurality of diverters include a plurality of flange portions for stopping the plurality of diverters from being raised beyond a predetermined position. The ledge portion receives the plurality of flange portions so that the plurality of diverters can be effectively supported at non-operating positions.

12 Claims, 4 Drawing Sheets

POP-UP SPRINKLER INCLUDING WATER SPRAY DIVERTER

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to irrigation systems and, more particularly, to a pop-up sprinkler including a manually adjustable spray diverter.

2. Prior Art

Sprinkler systems for residential lawns have become very popular so as to provide watering of the grass on a scheduled frequency. The typical sprinkler head mechanism allows the operating portion of the head to spring upward from the ground a few inches to allow the water to spray about in a pre-selected pattern so as to water a relatively wide area.

While there are many types of sprinkler heads, a common type includes a base, a spray nozzle and a poppet attaching the spray nozzle to the base. When water pressure is applied to the sprinkler head through the riser, the poppet is caused to move from a retracted to an extended position elevating the spray nozzle.

In a typical home installation, the sprinkler heads are mostly buried in the ground with only their upper surface being at ground level. The poppet elevates the spray nozzle above the ground level for effective dispersal of the water.

Unfortunately, the sprinkler spray often hits objects such as fences, walls, and cars that are vulnerable to repeated spraying. Objects such as these may rot, rust, mildew or stain when repeatedly sprayed. As a result, it is frequently desirable to direct the spray of a sprinkler away from such objects.

In addition, it is often desirable to adjust the direction of the spray of a sprinkler to cover areas previously not irrigated or receiving inadequate irrigation. While some sprinklers have the capability to increase or decrease the arc of their spray, it is often difficult to concentrate the spray in a concentrated, targeted direction.

Accordingly, a need exists for a sprinkler that can be manually adjusted to direct its spray to selected surrounding areas and away from objects that may be damaged by such spray.

BRIEF SUMMARY OF THE INVENTION

In view of the foregoing background, it is therefore an object of the present invention to provide a sprinkler for selectively irrigating ground surfaces. These and other objects, features, and advantages of the invention are provided by a sprinkler for diverting water flow in a select direction.

The sprinkler includes a base member having a centrally disposed longitudinal axis and a substantially annular shape.

The base member further has an opening centrally disposed about the axis and positionable above a ground surface.

A sprinkler head having a substantially cylindrical conduit extends along the axis and has a proximal end portion in fluid communication with a water supply source. The sprinkler head further has a distal end portion slidably movable between raised and lowered positions as water is selectively introduced therethrough respectively. The distal end portion has a plurality of tapered apertures randomly spaced thereabout for receiving a first array of water traveling in a first path generally parallel to the axis. The distal end portion further has a slot formed therein for defining a ledge along a select portion of the conduit. The slot has a substantially arcuate shape and is radially offset from a perimeter of the sprinkler head.

The sprinkler further includes a plurality of diverters for guiding the water array in a select direction. The plurality of diverters are slidably positionable within the slot and selectively movable between operating and non-operating positions as water flows through the conduit. The plurality of diverters each have a generally arcuate shape and are positionable along a select quadrant respectively.

Advantageously, the plurality of diverters include a plurality of flange portions extending substantially orthogonal to the axis and for stopping the plurality of diverters from being raised beyond a predetermined position. The ledge portion receives the plurality of flange portions so that the plurality of diverters can be effectively supported at non-operating positions. The plurality of diverters channel the first array of water into a second array of water having a second path extending at an oblique angle to the axis and traveling outwardly from the sprinkler head.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
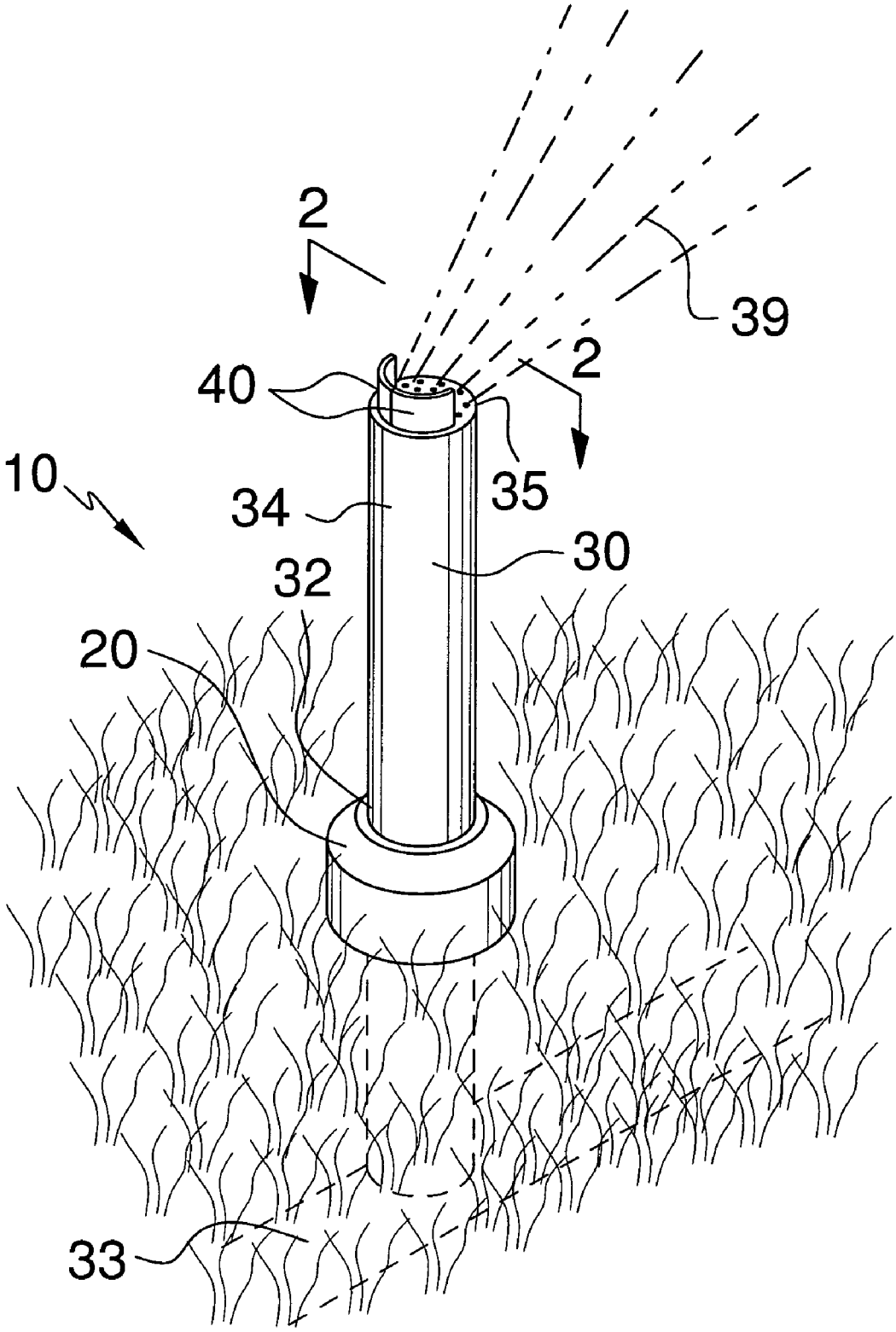
FIG. 1 is a perspective view showing the sprinkler at a raised position, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-5 by the reference numeral 10 and is intended to provide a pop-up sprinkler including a water spray diverter. It should be understood that the sprinkler 10 may be retrofitted onto existing sprinkler systems and may be employed in both residential and commercial settings.

Initially referring to FIG. 1, the sprinkler 10 includes a base member 20 having a centrally disposed longitudinal axis (not shown) and a substantially annular shape. The base member 20 further has an opening 21 centrally disposed about the axis and positionable above a ground surface. The low profile of the base member 20 enables it to be hidden from view by surrounding grass.

Figure 3:
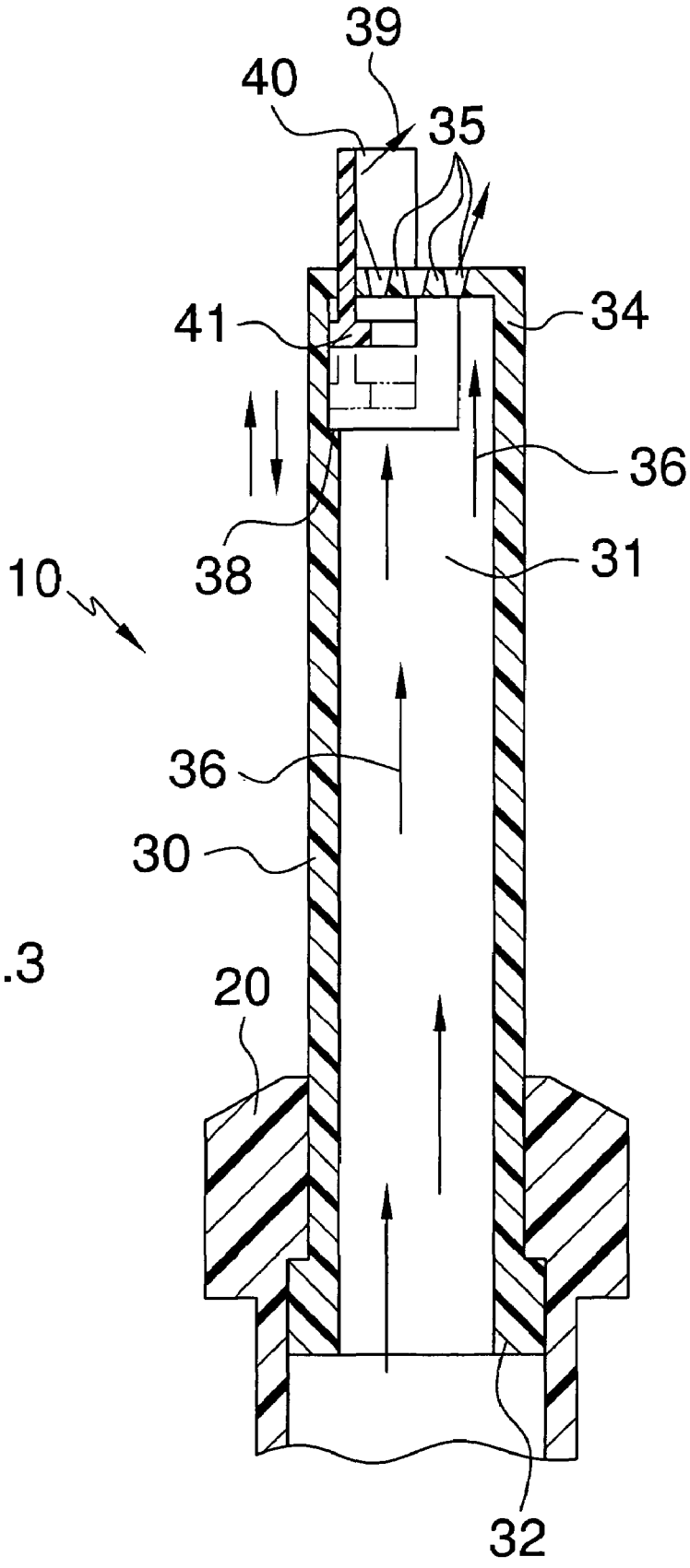
FIG. 3 is a cross-sectional view of the apparatus shown in FIG. 1, taken along line 3—3.

Now referring to FIG. 3, a sprinkler head 30 having a substantially cylindrical conduit 31 extends along the axis and further has a proximal end portion 32 in fluid communication with a water supply source 33. The conduit 31 assists in channeling water to the sprinkler head 30 during operating conditions. The sprinkler head 30 further has a distal end portion 34 slidably movable between raised and lowered positions as water is selectively introduced therethrough respectively. This allows the sprinkler head 30 to pop-up during operating conditions for unobstructed spraying.

The distal end portion 34 has a plurality of tapered apertures 35 randomly spaced thereabout for receiving a first array 36 of water traveling in a first path generally parallel to the axis. The distal end portion 34 further has a slot 37 formed therein for defining a ledge 38 along a select portion of the conduit 31. The slot 37 has a substantially arcuate shape and is radially offset from a perimeter of the sprinkler head 30, as best shown in FIG. 2.

Figure 2:
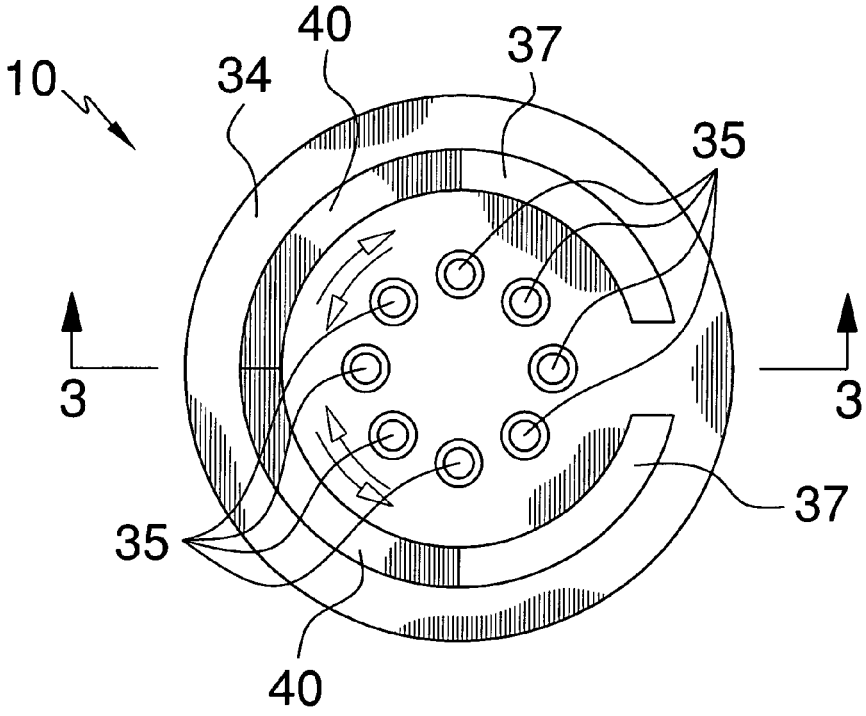
FIG. 2 is an enlarged top plan view of the sprinkler head shown in FIG. 1, taken along line 2—2.

Now referring to FIG. 2, the sprinkler 10 further includes a plurality of diverters 40 for guiding the water array in a select direction and away from objects requiring protection from such spray. The plurality of diverters 40 are slidably positionable within the slot 37 and selectively movable between operating and non-operating positions as water flows through the conduit 31. The plurality of diverters 40 each have a generally arcuate shape and are positionable along a select quadrant respectively.

Advantageously, the plurality of diverters 40 enable a user to selectively direct the flow of water to desired areas surrounding the sprinkler 10 and prevent certain outdoor objects such as fences, walls and cars from being sprayed. If repeatedly subjected to water spray, wood fences have a tendency to rot, walls have a tendency to mildew and stain, and cars have a tendency to rust. Diverting sprinkler spray away from these objects helps prevent damage and extends their useful life, thereby saving an owner time and money.

Figure 5:
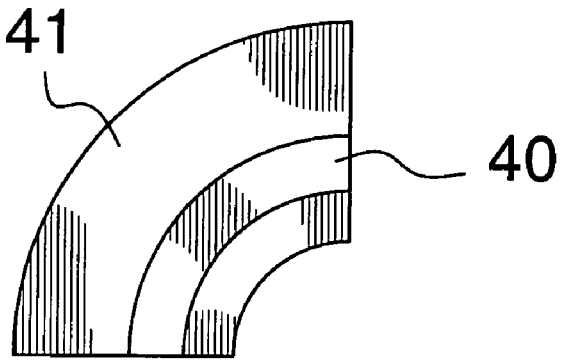
FIG. 5 is an enlarged top plan view of the diverter shown in FIG. 4, taken along line 5—5.
Figure 4:
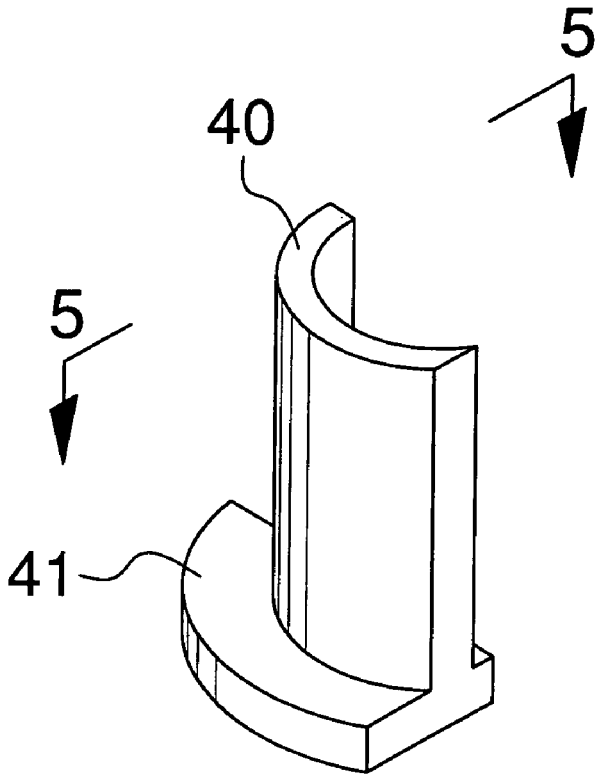
FIG. 4 is a perspective view of a diverter.

Now referring to FIGS. 4 and 5, the plurality of diverters 40 include a plurality of flange portions 41 extending substantially orthogonal to the axis and for stopping the plurality of diverters 40 from being raised beyond a predetermined position. The ledge portion 38 receives the plurality of flange portions 41 so that the plurality of diverters 40 can be effectively supported at non-operating positions, as best shown in FIG. 3. The plurality of diverters 40 channel the first array 36 of water into a second array 39 of water having a second path extending at an oblique angle to the axis and traveling outwardly from the sprinkler head 30 as also best shown in FIG. 3.

The sprinkler 10 provides an affordable, cost-effective method of diverting water spray away from objects requiring protection from water and towards areas needing irrigation. As a result, homeowners and other property owners would no longer need to prematurely replace objects such as fences, walls, and cars that have been damaged by repeated exposure to sprinkler spray. The sprinkler 10 could be used to modify existing irrigation systems or installed as part of new construction, and could be used by residential, commercial and institutional users.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A sprinkler for channeling water flow in a select direction, said sprinkler comprising:

a base member having a centrally disposed longitudinal axis and a substantially annular shape, said base member further having an opening centrally disposed about the axis and being positionable above a ground surface;

a sprinkler head having a substantially cylindrical conduit extending along the axis and having a proximal end portion in fluid communication with a water supply source, said sprinkler head further having a distal end portion slidably movable between raised and lowered positions as water is selectively introduced therethrough respectively, said distal end portion having a plurality of tapered apertures spaced thereabout for receiving a first array of water traveling in a first path, said distal end portion further having a slot formed therein for defining a ledge along a select portion of the conduit; and a plurality of diverters for guiding the water array in a select direction, said plurality of diverters being slidably positionable within the slot and selectively movable between operating and non-operating positions as water flows through the conduit, said plurality of diverters for channeling the first array of water into a second array of water having a second path extending at an oblique angle to the axis and traveling outwardly from said sprinkler head.

2. The sprinkler of claim 1, wherein said plurality of diverters comprise: a plurality of flange portions extending substantially orthogonal to the axis and for stopping said plurality of diverters from being raised beyond a predetermined position.

3. The sprinkler of claim 1, wherein said slot has a substantially arcuate shape and is radially offset from a perimeter of said sprinkler head.

4. The sprinkler of claim 1, wherein the slot defines a ledge portion for receiving said plurality of flange portions so that said plurality of diverters can be effectively supported at non-operating positions.

5. The sprinkler of claim 1, wherein said plurality of diverters each have a generally arcuate shape for being positionable along a select quadrant respectively.

6. A sprinkler for channeling water flow in a select direction, said sprinkler comprising:

a base member having a centrally disposed longitudinal axis and a substantially annular shape, said base member further having an opening centrally disposed about the axis and being positionable above a ground surface;

a sprinkler head having a substantially cylindrical conduit extending along the axis and having a proximal end portion in fluid communication with a water supply source, said sprinkler head further having a distal end portion slidably movable between raised and lowered positions as water is selectively introduced therethrough respectively, said distal end portion having a plurality of tapered apertures spaced thereabout for receiving a first array of water traveling in a first path, said distal end portion further having a slot formed therein for defining a ledge along a select portion of the conduit; and a plurality of diverters for guiding the water array in a select direction, said plurality of diverters being slidably positionable within the slot and selectively movable between operating and non-operating positions as water flows through the conduit, said plurality of diverters for channeling the first array of water into a second array of water having a second path extending at an oblique angle to the axis and traveling outwardly from said sprinkler head, said plurality of diverters comprise a plurality of flange portions extending substantially orthogonal to the axis and for stopping said plurality of diverters from being raised beyond a predetermined position.

7. The sprinkler of claim 6, wherein said slot has a substantially arcuate shape and is radially offset from a perimeter of said sprinkler head.

8. The sprinkler of claim 6, wherein the slot defines a ledge portion for receiving said plurality of flange portions so that said plurality of diverters can be effectively supported at non-operating positions.

9. The sprinkler of claim 6, wherein said plurality of diverters each have a generally arcuate shape for being positionable along a select quadrant respectively.

10. A sprinkler for channeling water flow in a select direction, said sprinkler comprising:

a base member having a centrally disposed longitudinal axis and a substantially annular shape, said base member further having an opening centrally disposed about the axis and being positionable above a ground surface;

a sprinkler head having a substantially cylindrical conduit extending along the axis and having a proximal end portion in fluid communication with a water supply source, said sprinkler head further having a distal end portion slidably movable between raised and lowered positions as water is selectively introduced therethrough respectively, said distal end portion having a plurality of tapered apertures spaced thereabout for receiving a first array of water traveling in a first path, said distal end portion further having a slot formed therein for defining a ledge along a select portion of the conduit; said slot has a substantially arcuate shape and is radially offset from a perimeter of said sprinkler head; and a plurality of diverters for guiding the water array in a select direction, said plurality of diverters being slidably positionable within the slot and selectively movable between operating and non-operating positions as water flows through the conduit, said plurality of diverters for channeling the first array of water into a second array of water having a second path extending at an oblique angle to the axis and traveling outwardly from said sprinkler head, said plurality of diverters comprise a plurality of flange portions extending substantially orthogonal to the axis and for stopping said plurality of diverters from being raised beyond a predetermined position.

11. The sprinkler of claim 10, wherein the slot defines a ledge portion for receiving said plurality of flange portions so that said plurality of diverters can be effectively supported at non-operating positions.

12. The sprinkler of claim 10, wherein said plurality of diverters each have a generally arcuate shape for being positionable along a select quadrant respectively.

* * * * *